United States Patent [19]

Chen

[11] Patent Number: 4,687,451

[45] Date of Patent: Aug. 18, 1987

[54] AUTOMATIC ACTUATION DEVICE FOR INFLATABLE LIFE-SAVING EQUIPMENT

[76] Inventor: Tsung H. Chen, P.O. Box 1-79, Taipei, Taiwan

[21] Appl. No.: 895,493

[22] Filed: Aug. 11, 1986

Related U.S. Application Data

[63] Continuation-in-part of Ser. No. 794,546, Nov. 4, 1985, abandoned.

[51] Int. Cl.[4] ..... B63C 9/14

[52] U.S. Cl. ..... 441/94; 441/95; 441/97; 441/100; 441/101

[58] Field of Search ..... 441/7, 8, 92, 93, 94, 441/95, 97, 100, 101; 222/5; 24/602

[56] References Cited

U.S. PATENT DOCUMENTS

| | | | |
|---|---|---|---|
| 1,329,990 | 2/1920 | Muller | 441/95 |
| 2,527,605 | 10/1950 | Walk | 441/94 |
| 2,531,586 | 11/1950 | Ramsey | 441/8 |
| 2,675,143 | 4/1954 | Seemann | 441/95 |
| 2,821,853 | 2/1958 | Ruskin et al. | 441/8 |
| 3,494,506 | 2/1970 | Fujimoto | 441/94 |
| 3,815,783 | 6/1974 | Hirata | 441/95 |

*Primary Examiner*—Joseph F. Peters, Jr.
*Assistant Examiner*—Thomas J. Brahan
*Attorney, Agent, or Firm*—Lalos & Keegan

[57] ABSTRACT

An improved automatic actuation device for inflatable life-saving equipment which comprises a housing, a compressed gas cylinder, a piercing pin for piercing the seal cap of the gas cylinder to open it, a L-shaped lever for driving the piercing pin and an automatic actuation device which will automatically operate when submerged in water to actuate the lever, characterized in that the automatic actuation device can be readily fitted on the compressed gas cylinder of any kind of the conventional life-saving equipment and comprises an outer cylinder, an inner cylinder, an actuating spring being compressing received between two cylinders, a water-soluble paper coil being surrounded around two projecting pins of the cylinders when two cylinders are pressed and fastened together and the water-soluble paper coil is used in the form of a replaceable unit.

6 Claims, 9 Drawing Figures

AUTOMATIC ACTUATION DEVICE FOR INFLATABLE LIFE-SAVING EQUIPMENT

This is a continuation-in-part of application Ser. No. 794,546 filed on Nov. 4, 1985, now abandoned.

BACKGROUND OF THE INVENTION

The present invention generally relates to a gas filling apparatus which will automatically fill gas into an inflatable life-saving equipment when it is submerged in water, and more particularly to an improved automatic actuation device for inflatable life-saving equipment which can be easily attached to a conventional manual gas filling apparatus so that the conventional manual inflatable life-saving equipment will immediately become an automatic operation when submerged in water.

Previously, many types of the water-soluble solid material have been proposed in the gas filling apparatus, such as described in U.S. Pat. No. 3,815,783 by Hirata and described in U.K. Pat. No. 1,198,867 by Fujimoto. Both of them have many defects.

Hirata discloses an automatic gas filling device which mainly comprises a U-shaped housing for mounting a gas cartridge 8 and an automatic actuation machanism 33 wherein a seesaw type driving lever 22 is particularly required in addition to a manual operating lever 25. This not only makes the construction complicated also increases the mechanic interferences. Once the fulcurm 23 is struck, the driving lever 22 would be out of work and paralyze the automatic and manual operation, even it is not so, it would be harder to pull the manual lever 25 when manual operation is needed in emergency.

Due to the above reason, the construction of gas filling apparatus of Hirata's patent at least includes a gas cartridge 8 with its holder (including a piercing pin 13) and a manual lever 25 with its pivot 24 on the second chamber which cannot be replaced with parts of the conventional, so its adaptability is greatly limited. In addition, the automatic actuation mechanism 33 on the second chamber is complicated and its reliability in operation is doubtful. The reason is that the mechanism 33 includes a capsule 46, a slide 45 with a stem 47, a wet restricting member 38, a bar 37, an actuation spring and a spring receiving member 38, in which the bar 37 is inserted in the locking hole 42 on the middle of spring receiving member 36, bifurcations 40 and 41 of the spring receiving member 36 are firmly held by member 38. In operation, if the action force of the actuation spring 35 is not big enough would not push the br 37 out of the member 38, because the lower end of the bifurcations 40 and 41 would bend outwardly, see FIG. 10. The decay problem and material selection for members 36 and 38 and spring 35 are concerned with the problem of complex and life-saving effectiveness. So if one of them changes would make the automatic gas filling function decreased or out of work.

As to Fujimoto's patent, he teaches a simpler construction for automatic gas filling device, but the gas cylinder 13 and seal cutter 12 should be installed together with specific designed casing 1. The restricting member 7 cannot be readily replaced with the conventional life-saving equipment, its adaptability is also limited and cannot be reused. Further, no matter it is adopted the type of sliding seal cutter 12 (see FIGS. 1, 10 and 11) or the type of sliding gas cylinder 13 (see FIGS. 3, 4, 7A and 9), to isolatedly separate the water chamber in casing 1 from the gas chamber is absolutely needed, it should adopt O-rings 11, 31 or packing 28, thus such seal parts and sliding members 9, 29, 46 will cause a great deal of friction force with the inside wall of casing 1, making the smoothness of sliding movement in cutting seal cap impossible.

Therefore, to overcome the above-mentioned problems, it needs not only to increase the expansion force of actuation spring, also to enforce the tensile strength of restricting members 7, 32, 37, 45 to withstand the expanding force of the spring under a dry condition. In this manner, the operating time of the restricting member, when submerged in water, will be much longer which will delay the gas filling operation, make the automatic life-saving equipment meaningless.

Accordingly, the present invention is to provide an automatic actuation device to fill the gas into life-saving equipment immediately when it is submerged in water.

An object of the present invention is to provide an improved automatic actuation device for life-saving equipment which will immediately open a gas cylinder by the operation of an automatic actuation device to fill the gas contained in the gas cylinder into an inflatable life-saving equipment at very short time when submerged in water.

Another object of the present invention is to provide an automatic actuation device for life-saving equipment which can be easily fitted to the conventional manual gas filling apparatus wherein the gas filling apparatus once submerged in water can be easily reset for repeated use by replacing its used water-soluble paper coil unit with a new one in the most economic condition.

A further object of the present invention is to provide an improved automatic actuation device which can be easily adapted to and removed from any kind of gas filling apparatus of the conventional life-saving equipment by hand operation without any need of tool.

A still further object of the present invention is to provide an improved automatic actuation device in which the whole water-soluble paper coil unit is encompassed with a water-proof film to prevent paper coil unit from being broken when accidentally contacted with moisture in the air.

A still further object of the present invention is to provide an improved automatic actuation device for life-saving equipment in which a water-proof pocket means is further provided on the whole device to prevent the water-soluble paper coil unit from being wet in rainy day caused unnecessary operation.

A still further object of the present invention is to provide an improved life-saving equipment which can be also used only as a manually operated apparatus by removing the automatic actuation device from the equipment and is adapted for swimming and diving.

The features and advantages of the present invention will be apparent from the detailed description of the embodiment of the present invention described in the following with reference to drawings. In the drawings.

Figure 1A:
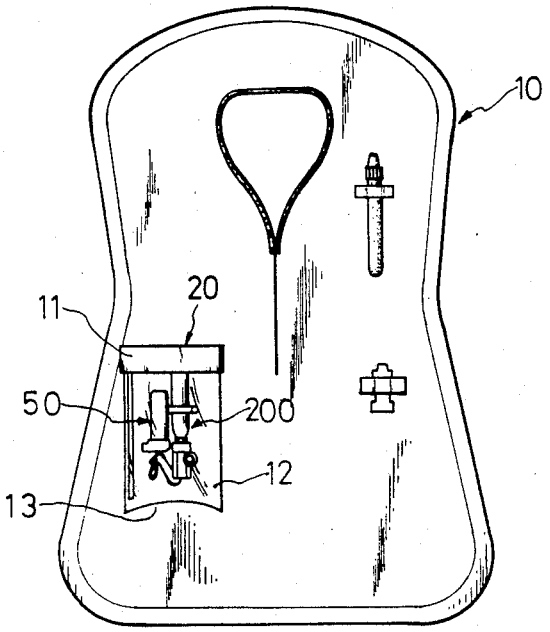
FIG. 1A is a front view of the present invention used on the conventional life-saving jacket.

The best mode for carrying out the present invention is presented in term of a preferred embodiment. In order to simplify the description, take life-saving jacket for example, referring to FIGS. 1 to 5, the important advantage of the present invention is that the automatic actuation device 50 can be easily fitted to and removed from the conventional gas filling apparatus 200 wherein the construction of gas cylinder 201, housing 205, D-shaped sleeve 204, piercing pin 206, L-lever 209 and pulling cord 210 are of the same with the conventional and are well-known to the art so that their relevant illustration are omitted accordingly.

The most distinguishing feature of the present invention is that a water-soluble paper coil unit 54 of the present invention can be easily put on and removed from the automatic actuation device 50 in the form of a replaceable unit, so that the life-saving equipment of the present invention once submerged in water can be very easily reset for repeated use in the most economic condition.

Figure 2:
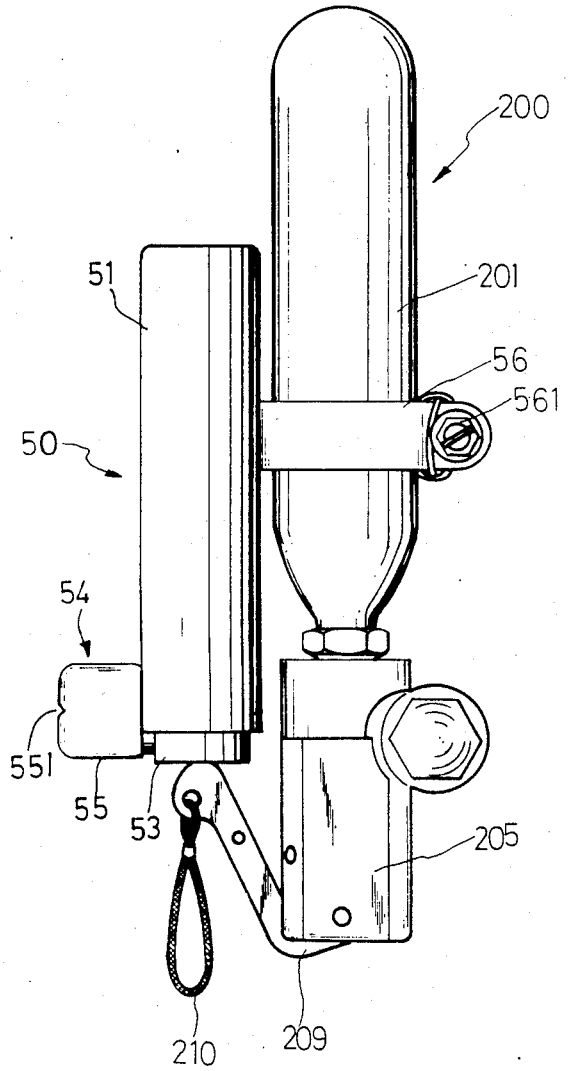
FIG. 2 is a front view of the gas filling apparatus in which an automatic actuation device of the present invention is attached thereto.

The detailed illustration of the automatic actuation device 50 of the present invention will be described hereinafter:

As shown in FIG. 2, the device 50 is removably fited on the outer surface of gas cylinder 201 by a fastened elements 56, 561 making the device bottom contacted with lever 209, then, the combination of automatic actuation device 50 and gas filling apparatus 200 is thus completed.

Figure 3:
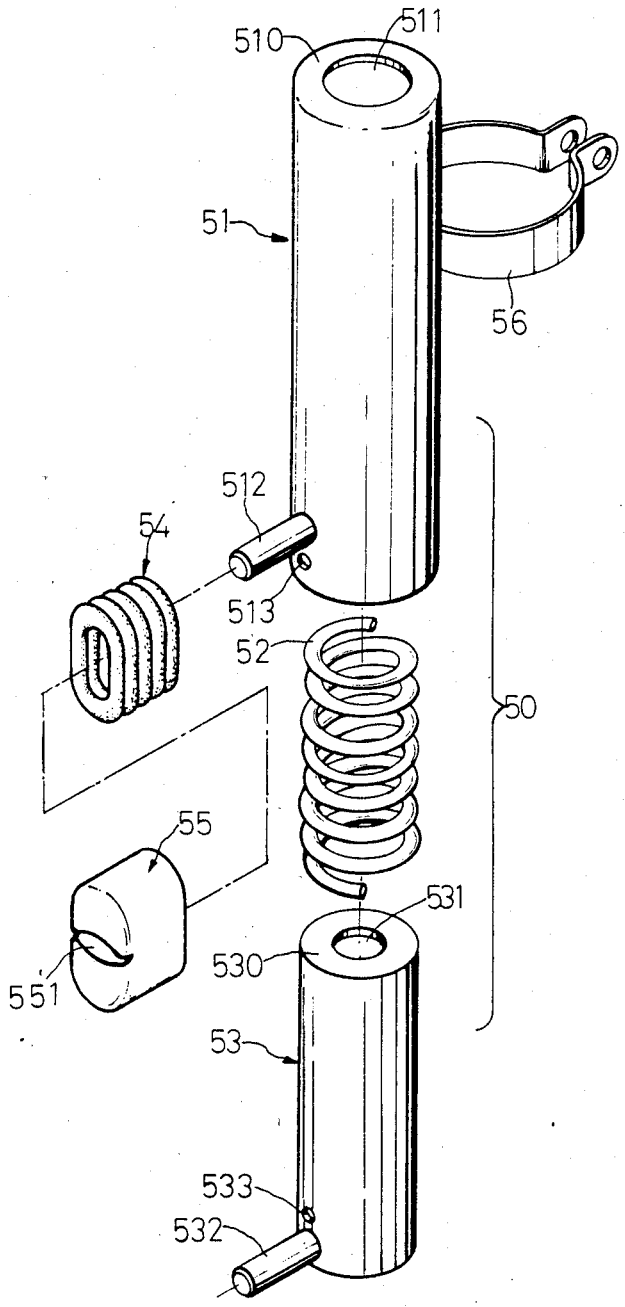
FIG. 3 is an exploded perspective view of the present invention.
Figure 4:
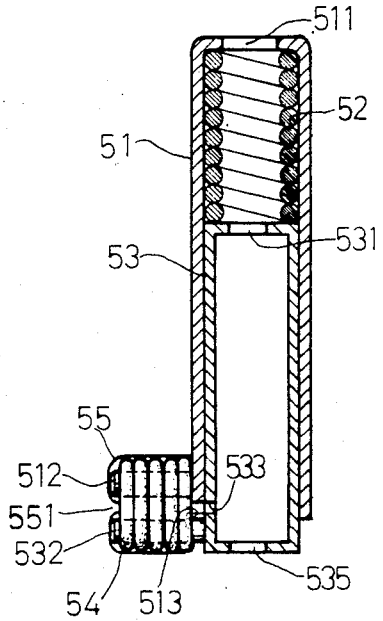
FIG. 4 is a cross-sectional view of the present invention.

As shown in FIGS. 3 to 5, the automatic actuation device 50 of the present invention includes an outer cylinder 51, an inner cylinder 53, an actuation spring 52, a water-soluble paper coil unit 54 and a water-proof film 55 covered on the whole paper coil unit. There are a water-passing hole 511 on the top of outer cylinder 51, a spur pin 512 provided at the lower portion of outer cylinder 51 and a water-passing hole 513 provided under the spur pin 512. The inner cylinder 53 can be received within the outer cylinder 51, also there are a water-passing hole 531 on the top, a spur pin 532 at the lower portion thereof, a water-passing hole 533 at the upper portion of the spur pin 532. The top of actuation spring 52 firmly fixed to the inner top of the outer cylinder 51 and the bottom of actuation spring 52 further fixed to the top of the inner cylinder 53 so that the inner cylinder 53, spring 52 and outer cylinder 51 are connected together.

Figure 5A:
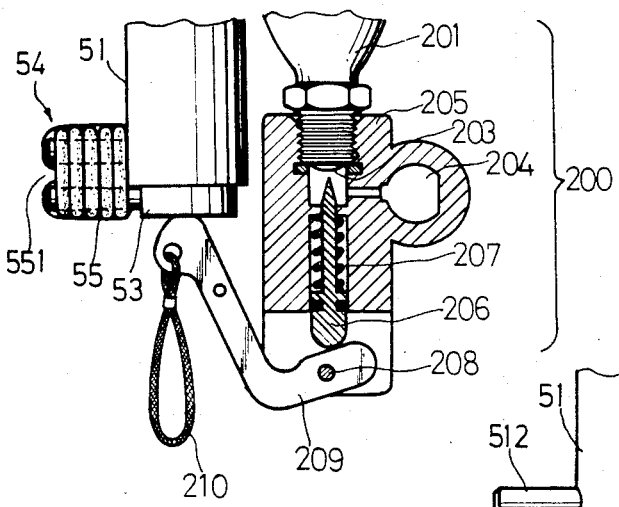
FIGS. 5A to 5C are schematic views of operation illustration of automatic actuation device of the present invention.
Figure 5C:
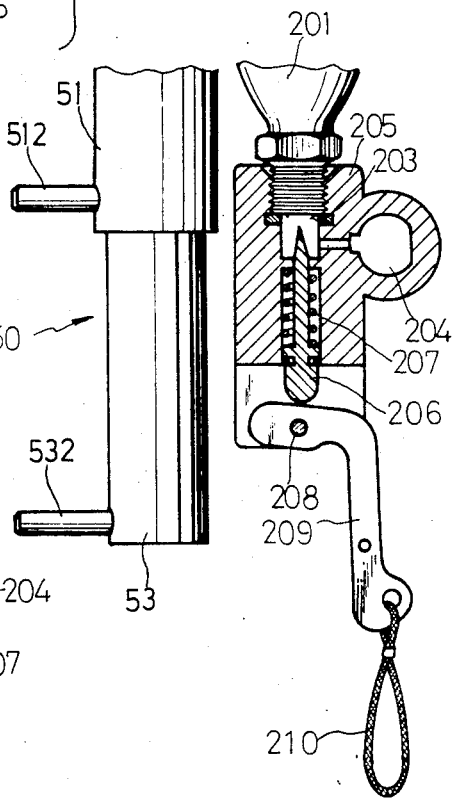
Figure 5B:
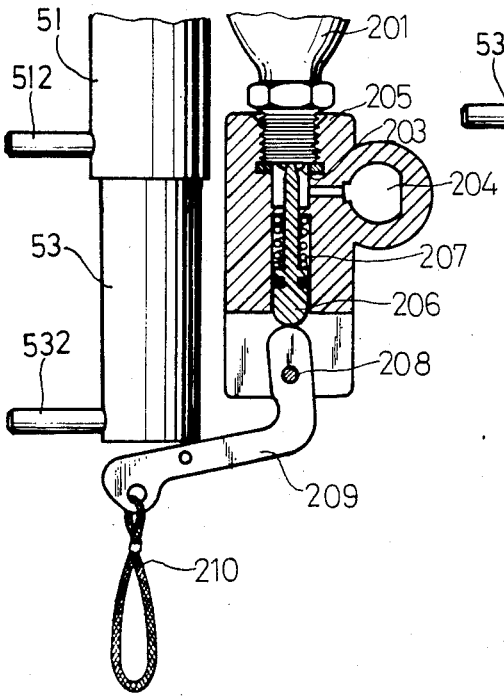

The inner cylinder 53 is then pressed into the outer cylinder 51 so as to store a given amount of spring force therein, also, the two spur pins 512 and 532 of outer and inner cylinders are fastened together, by surrounding a water-soluble paper coil 54 around them so as to prevent the two cylinders from being moved apart by the stored spring force. It should be understood that the water-soluble paper coil should withstand the expanding force of actuation spring 52 compressed between two cylinders under a dry condition, that is, when the paper coil in dry condition, its tensile strength is greater than the expanding force of actuation spring 52. If the paper coil 54 is submerged in water, its tensile strength will be broken down to lose it fastening force to the cylinder; simultaneously, see FIGS. 5A to 5C, the stored force in actuation spring 52 is released to become a driving force to drive the bottom of inner cylinder 53 downwards and then to push the L-lever 209 also downwards and the the other end of L-lever 209 will in turn push the piercing pin 206 upwards, making the seal cap 203 broken. In the meantime, the inner cylinder 53 pushes downwards continually to make L-lever 209 rotate in a manner as shown in FIG. 5C. Then, the spring 207 pushes piercing pin 206 downwards, making the gas contained in cylinder 201 filled into life-saving equipment through D-shaped sleeve 204.

In avoiding unnecessary actuation operation owing to contact with moisture in the air when it is stand-by. Aforementioned water-soluble paper coil unit 54 is to be covered by a plastic film 55, see FIGS. 3 and 5A.

In principle, the thickness of the plastic film 55 should not influence the instant breaking operation of water-soluble paper coil when submerged in water.

Thus, there is a hole 551 outside the film 55 in order to match the water-passing holes 513, 533 of outer cylinder 51 and inner cylinder 53 when outer and inner cylinders are fastened together. So, once the life-saving equipment is suberged in water, the paper coil 54 will be cut out in a very short time to fill the gas into the equipment.

Because of convering the water-proof plastic film 55 on the outside of paper coil 54, the paper coil 54 becomes a consuming part. It means that the life-saving equipment can be repeatedly used by replacing the used gas-filling cylinder 201 and used paper coil 54. This is the important feature of the present invention. Besides, during change parts, it only takes hands to release the used gas filling cylinder from housing and screw on with a new one. Also, it takes hands to press spur pins 512, 532 of outer and inner cylinders together, and then put on the new paper coil 54 around them. After that the all changing procedures are completed. The present invention can be used widely in the gas filling cylinder of any kind of conventional life-saving equipment not only with quick change but also in the most economic condition.

Figure 1B:
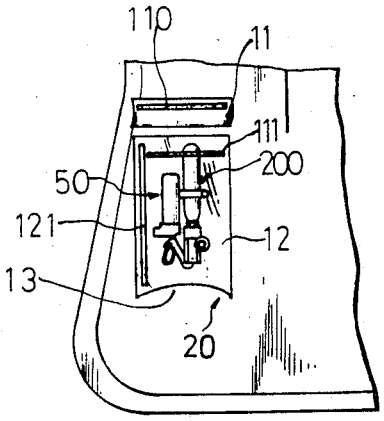
FIG. 1B is a partial view of FIG. 1A showing the cover of pocket means is open.
Figure 1C:
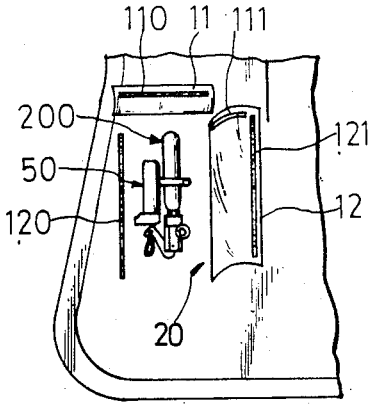
FIG. 1C is a partial view of FIG. 1A showing the pocket means is completely open.

In addition, in avoiding unnecessary, wrong operation caused by the wet life-saving equipment in rainy day, the life-saving equipment is further provided a water-proof pocket means 20, see FIGS. 1A to 1C, the bottom of the pocket means 20 is open in normal condition, it provides a passageway for inducing water into the automatic actuation device when life-saving jacket is submerged in water. For convenience, the water-proof pocket means 20 is consisted of an openable pocket cover 11 and no bottom pocket member 12. One side of the pocket member is fixed on jacket, and the inner of other side thereof is set an openable and closable magic tape 121 which can stick with the magic tape 120 provided on the life-saving jacket. The top edge of the pocket cover 11 is fixed, the inner side of the lower edge thereof is fitted with an openable and closable magic tape 110 in order to tie up with the top tape 111 on pocket member 12 to effectively prevent the paper coil 54 from being broken when accidentally contacted with rain or water during stand-by.

I claim:

1. An improved automatic actuation device for inflatable life-saving equipment comprising:

a housing firmly fitted on a sack of an inflatable life-saving equipment, having a connecting conduit communicating therebetween;

a compressed gas cylinder having a sealing cap being removably mounted on said housing;

a piercing pin for piercing said sealing cap provided under said sealing cap within said housing;

a L-shaped lever having a pivot below said piercing pin for moving said piercing pin to cause same to pierce said sealing cap when said lever is rotated, the bottom end of said piercing pin contacting the first end of said L-shaped lever, the second end thereof positioned above the first end; characterized in that an automatic actuation device mounted on said compressed gas cylinder comprising:

an outer cylinder having a projecting pin at the lower portion thereof;

an inner cylinder having a projecting pin at the lower portion thereof, said inner cylinder being inserted into the outer cylinder except the portion of said projecting pin;

an actuating spring being compressively received inside said outer cylinder between the inside top portion of said outer cylinder and the outside top portion of said inner cylinder;

a replaceable water-soluble paper coil unit being surrounded on said two projecting pins upon said outer and inner cylinders being pressed and fastened together;

when submerged in water, said water-soluble paper coil unit is immediately broken to lose its fastening force to said outer and inner cylinders, the stored force in said actuation spring is released to push said inner cylinder downwards and thus makes said second end of L-shaped lever rotate in counter-clockwise direction around its pivot so as to cause said first end of said L-shaped lever to drive said piercing pin to pierce said sealing cap, the gas contained in said compressed gas cylinder being induced into the sack of the life-saving equipment.

2. An improved automatic actuation device as claimed in claim 1, wherein a water-proof film is further provided to encompass the whole of said water-soluble paper coil unit.

3. An improved automatic actuation device as claimed in claim 2, wherein said water-soluble paper coil unit which is immediately broken when submerged in water comprises:

a first water-passing hole provided on the top of said outer cylinder;

a second water-passing hole provided at the lower portion of said outer cylinder and below the projecting pin of the same;

a third and fourth water-passing holes provided on the top and bottom ends of said inner cylinder, respectively;

a fifth water-passing hole provided at the lower portion of said inner cylinder above the projecting pin of the same;

a sixth water-passing hole provided on the outer face of said water-proof film between two outer ends of projecting pins when said two projecting pins of the inner and outer cylinders are fastened together by said water-soluble paper coil unit, said first, third and fourth water-passing holes are aligned together and said second, fifth and sixth water-passing holes are also aligned together, forming an access for water passing through said water-soluble paper coil unit, in the shortest time during an emergency.

4. An improved automatic actuation device as claimed in claim 1, wherein a water-proof pocket means with an open bottom is further provided on life-saving equipment to cover the whole device to prevent it being wet when it is stand-by in rainy day.

5. An improved automatic actuation device as claimed in claim 4, wherein said pocket means comprises an openable and closable pocket cover and pocket member to enable the user to operate it as desired.

6. An improved automatic actuation device as claimed in claim 1, wherein the top end of said actuation spring is fixed with the inner top of said outer cylinder and the bottom end thereof is fixed with the top portion of said inner cylinder so as to connect all of them together.

* * * * *